United States Patent [19]

D'Antonio et al.

[11] Patent Number: 4,632,860

[45] Date of Patent: Dec. 30, 1986

[54] WATERPROOF BREATHABLE FABRIC

[75] Inventors: John P. D'Antonio, Hockessin, Del.; Joseph F. Murphy, Matawan, N.J.

[73] Assignee: D'Antonio, Hockessin, Del.

[21] Appl. No.: 711,299

[22] Filed: Mar. 13, 1985

Related U.S. Application Data

[63] Continuation-in-part of Ser. No. 585,455, Mar. 2, 1984, abandoned.

[51] Int. Cl.[4] ..... B32B 27/08; B32B 27/10; C09J 7/02

[52] U.S. Cl. ..... 428/290; 428/332; 428/343; 428/354; 428/421; 428/423.1; 428/424.4; 428/442; 428/475.8; 428/483; 428/537.5

[58] Field of Search ..... 428/215, 332, 341, 424.1, 428/423.1, 342, 244, 343, 354, 424.4, 290, 537.5, 483, 421, 442, 475.8; 128/156

[56] References Cited

U.S. PATENT DOCUMENTS

| | | | |
|---|---|---|---|
| 4,367,327 | 1/1983 | Holker et al. | 428/423.1 X |
| 4,423,185 | 12/1983 | Matsumoto et al. | 423/423.1 X |
| 4,427,737 | 1/1984 | Cilento et al. | 428/343 X |
| 4,454,191 | 6/1984 | Blucher et al. | 428/244 |
| 4,485,809 | 12/1984 | Dellas | 128/156 |

*Primary Examiner*—Thomas J. Herbert
*Attorney, Agent, or Firm*—Darby & Darby

[57] ABSTRACT

Disclosed is a waterproof, moisture-breathable, non-macerating and hypoallergenic fabric including a moisture-absorbent, non-macerating hypoallergenic substrate formed from natural or synthetic fibers, the moisture absorbency of the substrate being provided by the inherent moisture absorbency of the fiber selected and the attractive capillarity of the formed substrate. An acrylic polymer basecoat is coated onto said substrate. The basecoat has sufficient viscosity when applied to prevent strikethrough when the basecoat is applied to the substrate. A topcoat is selected from the group consisting of polyether urethane and silicone latex and is coated onto the basecoat.

12 Claims, 3 Drawing Figures

WATERPROOF BREATHABLE FABRIC

RELATED APPLICATION DATA

This application is a continuation-in-part of parent application Ser. No. 585,455 filed Mar. 2, 1984, now abandoned.

FIELD OF THE INVENTION

The present invention relates to fabrics used in health care products, and more particularly to fabrics intended for prolonged direct contact with skin.

BACKGROUND OF THE INVENTION

There are many applications in health care that require prolonged direct contact between skin and tape or fabric. For example, adhesive tape is widely used to secure gauze bandages to a specific portion of the skin, such as a wound site. Self-contained adhesive bandages are mass-marketed for similar use. Special applications such as therapeutic patches for intradermal drug delivery also require intimate contact between fabric or tape and the skin.

Conventional tapes or fabrics trap moisture vapor between the skin and the tape and can cause maceration of the skin. Skin maceration is a condition of softening and separation of the skin from connecting tissue caused by wetting or steeping. Maceration contributes to a prolonged healing time, is uncomfortable to the user and often results in loss of adhesion between the skin and the adhesive applied to the tape at a point where the tape meets the skin.

It is desirable for tapes and fabrics used in health care applications to be waterproof in order to keep foreign material including viruses and bacteria away from the skin and accompanying wound site and also to provide a dry environment for expedited healing of the wound. However, conventional waterproof tapes and backings are usually made of polyvinyl chloride and polyethylene. Although these materials are waterproof they have the disadvantage of trapping moisture, i.e., they are non-breathable. Moisture vapor generated by the skin is unable to evaporate or dissipate because the fabric or tape seals the vapor between the tape and skin. This moist environment prolongs healing time and results in maceration.

Numerous attempts have been made to overcome these disadvantages, for example by providing a porous material which allows water vapor to escape. Porosity is generally achieved by providing macroscopic holes or pores in the tape or fabric. Although this increases breathability, waterproofness is lost.

To reduce the incidence of maceration and thereby reduce healing time it is desirable to provide a tape or fabric which is both waterproof and breathable. At the same time, the tape or fabric must be hypoallergenic for use in health care products.

A waterproof, breathable fabric has previously been developed having a multifilament nylon fabric substrate of 220 denier, 40×40 count, coated with a first layer of a mixture of ethyl and butyl acrylate and a second layer of microporous polyester urethane coated onto the first layer. Although this fabric is somewhat waterproof and breathable, the nylon, nonabsorbent substrate fabric cannot be used as a tape or fabric in health care applications. This fabric is not suitable for prolonged, direct contact with skin because the nylon substrate used has a low attractive capillarity; hence it is non-moisture absorbent and therefore does not pass moisture vapor through the acrylic and polyurethane layers as effectively as an absorbent substrate. This fabric is useful in rainwear garments (for example) where prolonged, direct contact with skin does not occur. Use of the fabric in applications involving prolonged direct contact with skin would result in maceration of the skin.

It is an object of the present invention to provide a fabric capable of prolonged, direct contact with skin which is waterproof, breathable, non-macerating and hypoallergenic.

SUMMARY OF THE INVENTION

The present invention includes a waterproof, moisture-breathable, non-macerating and hypoallergenic fabric including a moisture-absorbent, non-macerating hypoallergenic substrate formed from natural or synthetic fibers, the moisture absorbency of the substrate being provided by the inherent moisture absorbency of the fiber selected and the attractive capillarity of the formed substrate. An acrylic polymer basecoat is coated onto the substrate and has a thickness of from about 0.1 mil to about 10 mil. The basecoat has sufficient viscosity when applied to prevent strikethrough when the basecoat is applied to the substrate. A topcoat selected from the group consisting of polyether urethane, and silicone latex is coated onto the basecoat, the topcoat having a thickness of from about 0.1 mil to 10 mil.

DETAILED DESCRIPTION

Figure 2:
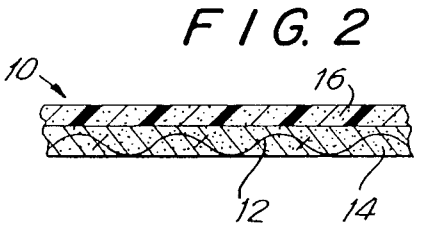
FIG. 2 is a cross-sectional view taken through FIG. 1 along line 2—2.
Figure 1:
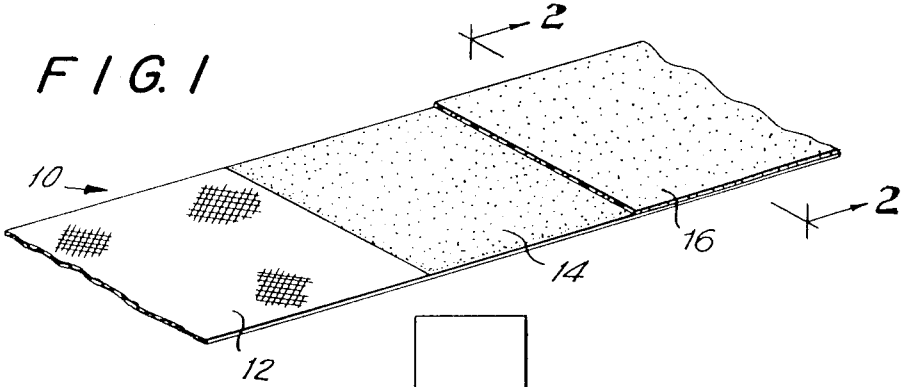
FIG. 1 is a perspective view partly broken away showing the layers of the fabric of the present invention.

Referring now to the drawings and in particular to FIG. 1, the fabric 10 of the present invention is shown in a perspective view partly broken away, as comprising three different layers 12, 14 and 16. The substrate 12 supports coating layers 14 and 16 and must be moisture absorbent and capable of wicking moisture. Suitable materials for substrate 12 include cotton, wool, paper products, polyester or polyester/cotton, acrylic, modacrylic, rayon, acetate, triacetate, nylon 66, nylon 6, spandex, glass, anidex, saran, matrix, aglon and "TEFLON". Other natural or synthetic fibers may be used. Polyester woven with cotton improves the tear strength and overall durability of the fabric. The material, or combination of materials, selected as a substrate must be fabricated to provide moisture absorbency. This can be accomplished by conventional means, well known in the art, for example, by varying the weave or knit pattern, denier, or number of filaments.

In this manner, the moisture absorbency of a substrate can be enhanced beyond the inherent moisture absorbency of the material used to form the substrate by increasing the attractive capillarity of the substrate. Hence, a material having a low inherent moisture absorbency capability (such as polypropylene having a water absorbancy of 0.01–0.1% at 70° F., 65–95% relative humidity) can provide an acceptable moisture absorbent substrate by forming a fabric which provides attractive capillarity. In fabricating the substrate, it is essential to ensure that the fabric design chosen does not contribute to maceration. For materials of high inherent moisture absorbency, such as cotton (7.0–8.5% at 70°, 65% relative humidity) it is is not necessary to fabricate the substrate in order to increase attractive capillarity. Non-woven absorbent substrates can also be used. Preferred non-woven substrates include polyethylene and polypropylene webs in either dot or scrim patterns. Non-woven fabrics of polypropylene, polyester and rayon are also preferred. Non-woven fabric substrates are advantageous in that a smooth coating surface is provided which ensures greater coating adhesion of coating layers to fabric 10 and an overall increase in visual and textural aesthetics ("hand") of the resultant fabric 10. The non-woven fabric substrates generally have an absorption ability similar to that of cotton and are typically less expensive than woven fabric substrates.

An acrylic latex of primarily butyl acrylate is used for basecoat 14 which is coated onto substrate 12. The latex may include other monomers or polymers such as polystyrene and ethyl acrylate, and cross linking modifiers such as methacrylic acid, carboxyl groups, and other reactive groups commonly added to acrylic latices. Crosslinked acrylates withstand washing and are relatively inexpensive. Butyl acrylate is particularly desirable because as a film it yields a very soft hand, some hydrostatic resistance, and yet is breathable. The acrylic basecoat is also advantageous in that acrylates generally have a high oxygen transmission rate which enhances the breathability of the fabric of the present invention. A high hydrostatic resistance imparts waterproofness to the fabric. However, although acrylics provide breathability and hydrostatic resistance as well as a soft texture or "hand", they are also tacky to the touch and do not offer the high abrasion resistance necessary for use in fabric applications.

Topcoat 16 is provided to furnish fabric 10 with an abrasion-resistant, waterproof and non-tacky outer layer. Either polyether urethane or silicone latex is used to provide topcoat layer 16. The polyether urethane topcoat provides abrasion resistance and a dry, non-tacky surface to fabric 10. Polyurethane also adds strength to the fabric. The tensile strength of the basecoat acrylic layer is approximately 200 psi (pounds per square inch). The tensile strength of polyether urethane is more than 2000 psi. Polyurethane layer 16 adheres to the basecoat acrylic latex layer in part due to the reactivity of melamine groups of polyurethane and reactive side groups of acrylic latex. The adhesion reaction occurs when coated fabric 10 is heated above 310° F. Polyether urethane is preferred over polyester urethane because polyether urethane is more water resistant and breathable than polyester urethane.

Alternatively, silicone latex can be used as topcoat 16. Silicone provides excellent "slip" and "hand" characterisics. However, silicone is more expensive than polyurethane. Both polyurethane and silicone latex are capable of high moisture vapor transmission rates (MVTR). MVTR is a quantifiable expression of breathability of the fabric. Compounding materials such as surfactants, fillers, and thickeners can also increase MVTR significantly. Any hygroscopic additive increases MVTR and any hydrophobic additive will decrease the MVTR.

Pigments can be added to either the basecoat or topcoat layer, or both, in a conventional manner to achieve a desired appearance of the fabric.

The texture and breathability of polyurethane topcoat 16 can be improved by imparting microporosity to the layer. Microporous polyurethane can contain up to approximately 65% air by volume, resulting in an extremely soft "hand". Pores are created in the polyurethane layer by blending the polyurethane with high amounts of fine mesh sodium chloride crystals before the polyurethane layer is applied to substrate 12. The sodium chloride is leached from the polyether urethane after the coating is cured onto the fabric. The resultant pores improve the texture, and increase the surface area for water vapor transmission and, depending on the application of the fabric, allow direct contact of air into the wound or skin covered by the fabric.

When imparting microporosity to polyurethane it is possible to use melamine-cured polyurethane. However, use of a thermoplastic urethane (TPU) is preferred due to the very high tensile strength (approximately 5000 psi) associated with TPU compounds. The increased tensile strength of the polyurethane is necessary to counteract the diminution in tensile strength which occurs when the polyurethene is made microporous. Microporous silicone is not preferred because the low tensile strength of silicone (400 psi) drops below acceptable limits when silicone is made microporous.

Figure 3:
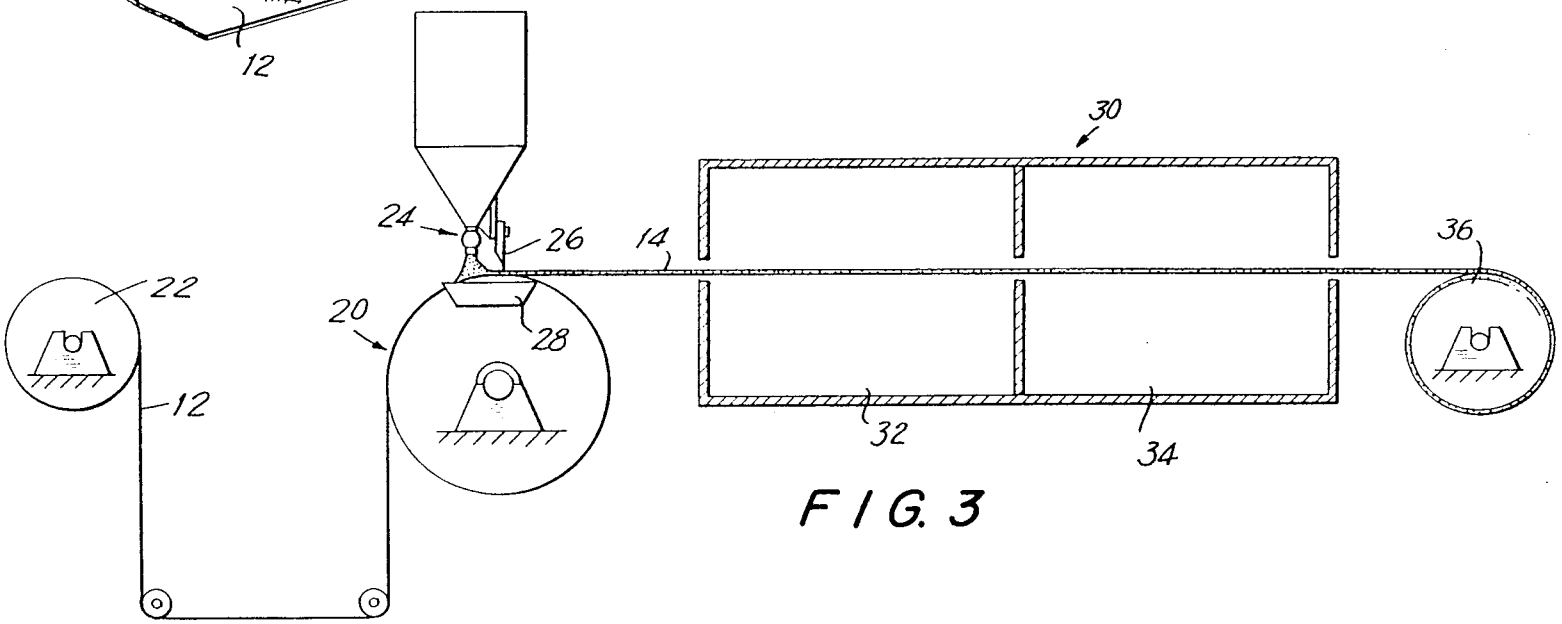
FIG. 3 is a schematic view showing an assembly for manufacturing the fabric of FIGS. 1 and 2.

FIG. 3 schematically illustrates the coating process for producing fabric 10. Substrate 12 is provided from a supply spool 22 and fed into a knife over roll assembly 20. Substrate 12 passes under a coating dispenser 24 where the acrylic latex basecoat 14 is coated onto substrate 12. The viscosity of the basecoat should be at least 20,000 cps (centipoise) when applied to substrate 12. Lower viscosity can result in strikethrough of the coating through the substrate. The proper viscosity is easily achieved using commercially available thickeners, as necessary. A doctor blade 26 controls the coating thickness and excess basecoat latex is collected in a collector 28 for re-use. Substrate 12, now coated with basecoat 14, enters a two-zone oven 30 at an approximate rate of 10 yards per minute, depending on the coating thickness employed and the substrate used. The two-zone oven should be approximately 40 to 60 feet long for a coating speed of 10 yards per minute. A first heating zone 32 and second heating zone 34 dry and cure the basecoat layer onto substrate 12 at a curing temperature of approximately 240° F. primarily to evaporate the water from the acrylic latex. The basecoat-coated substrate is then collected on a takeup spool 36.

The basecoat coated substrate on takeup spool 36 is then subjected to a second coating to provide topcoat 16 over basecoat 14. A topcoat layer can be provided by continuously feeding the basecoat-coated substrate into a second knife over roll assembly as it emerges from the two-zone oven, providing the polyurethane or silicone topcoat. Alternatively, the takeup spool 36 spooled with the basecoat-coated substrate can simply be exchanged with supply spool 22 of the original basecoat assembly and coating dispenser 24 provided with topcoat 16 which can then be applied to the basecoat-coated substrate. The optionally microporous polyurethane or silicone topcoat should be applied to the basecoat at a viscosity of approximately 1000–20,000 cps depending on the equipment used. The viscosity of the topcoat is not as important as that of the basecoat in that the topcoat is supported entirely by the basecoat and there is little danger of strikethrough.

The temperature provided by the two-zone oven for the topcoat coating step is important. A temperature of over 310° F. is necessary to cure silicone, urethane and acrylic polymers. A final curing step strengthens the polymers and increases adhesion between the three layers of fabric 10.

Other coating methods can be used to apply basecoat 14 and topcoat 16 to substrate 12. Such methods include floating knife and reverse roll coating techniques. The basecoat and topcoat can be applied in as many passes as desired to attain a desired thickness of the fabric. The maximum coating weight for a single coat is approximately 2 oz/yd$^2$ (ounces per square yard). Greater weight can result in blistering or poor drying, unless the coating is loaded with salt to impart microporosity. A salt loaded coating can be applied at a coating weight of up to 5 oz/yd$^2$.

The following examples are presented for purposes of illustrating the invention.

EXAMPLE I

An acrylate basecoat was prepared from Reichold 2671 acrylic copolymer of styrene and butyl acrylate latex in $H_2O$ (40% dry weight) (obtained from Reichold Co. of Dover, Del. This copolymer is a self cross-linking acrylate. 10 parts dry weight of copolymer (250 parts wet weight) were blended with 1.5 parts wet weight of Unithick thickener (obtained from Union Color and Chemical Co., of Morgantown, N.C.) for 2 minutes at 72° F. 0.5 parts $NH_4OH$ (ammonium hydroxide) were added to raise the pH to approximately 7.0. The increased pH of approximately 7.0 activates the thickener and raises the viscosity from less than 500 cps to approximately 20,000 cps. After stirring for 2 minutes at 72° F. the acrylic basecoat was then transferred to a coating dispenser for application to a substrate.

EXAMPLE II

A microporous polyurethane topcoat was prepared from polyether urethane TC 201 (obtained from Mill Master Onyx of Lyndhurst, N.J.) provided in 35% total solids solution in a 1:1 blend of N,N-dimethyl formamide (DMF) and toluene. 100 parts dry weight of polyurethane was blended with 500 parts dry weight of 325 mesh sodium chloride (NaCl) TFC 325 (obtained from Morton Salt Division of Morton Thiokol, Inc. of Chicago, Ill.) for 10 minutes at 72° F. Sufficient toluene was added to wet out the salt and adjust the viscosity of the topcoat to 5000 cps. The polyurethane topcoat was then ready for coating onto the basecoat coated substrate.

EXAMPLE III

Cotton gauze sheeting of 80×52 count and having a weight of 2 ounces per square yard, (obtained from Dundee Mills, New York, N.Y.) was fed into a knife over roll assembly at a rate of 10 yards per minute. The acrylic basecoat of Example I was gravity coated onto the cotton sheeting at a weight of 1–2 oz/yd$^2$ at a temperature of 72° F. The knife was set to obtain a basecoat coating thickness of approximately 1–2 mil. The coated cotton sheeting was passed through a two-zone oven, 60 feet long, manufactured by Chesmont Engineering Coproation at a rate of 10 yards per minute at a temperature of 240° F. to drive off water ($H_2O$) from the acrylic copolymer latex. The basecoat coated cotton was collected on a takeup spool. The takeup spool was transferred to the position of the supply spool. The coating dispenser of the knife over roll assembly was filled with the polyurethane topcoat of Example II. The acrylic coated cotton was fed into the knife over roll assembly at a rate of 10 yards per minute and the polyurethane topcoat was applied in two passes through the assembly at a temperature of 72° F. and a total weight of 9 oz/yd$^2$ (weight includes the NaCl). The polyurethane-coated fabric was then introduced to the two-zone oven at a rate of 10 yards per minute and heated at 200° F. in zone 1 in order to remove volatile solvents and cured in zone 2 at 250° F. to further dry the polyurethane and cure the acrylic basecoat. The cured, coated fabric emerging from the oven was then collected on the takeup spool. The coated fabric was then washed by three separate rinses in lukewarm $H_2O$ in 15 minute cycles in order to leach out the NaCl from the polyurethane layer of the coated fabric. After drying at 250° F. the final fabric had a weight of 5 oz/yd$^2$ and a thickness of 0.10 inches.

EXAMPLE IV

The fabric of the present invention was manufactured according to Example III except that a silicone topcoat was utilized rather than microporous polyurethane. Silicone latex obtained from Dow Corning of Midland, Mich. having a viscosity of 20,000 cps was substituted for the polyurethane topcoat of Example III and was applied to the basecoat coated cotton. The drying and curing steps were conducted at 240° F.

TEST I

The fabric of Example III was subjected to a Mullen hydrostatic waterproofness test to determine the hydrostatic resistance of the fabric. Federal Test Method 5512 was conducted. The fabric was found to have a hydrostatic resistance of 100 psi.

TEST II

The fabric of Example III was subjected to an ASTM test procedure for moisture vapor transmission rate (MVTR). ASTM test No. E96-BW resulted in an MVTR of 5 grams per 24 hours per 100 square inches. Additionally, the fabric of Example III was subjected to a Gore Modified Desiccant Method for MVTR which resulted in an MVTR of 7500 grams per 24 hours per square meter.

TEST III

The fabric of Example III was subjected to a peel adhesion test. Two one inch strips of fabric were glued together and separated at a rate of 12 inches per minute. Peel adhesion test ASTM No. D3330, resulted in a peel adhesion force of 4 pounds per inch.

TEST IV

The fabric of Example III was subjected to a rabbit skin irritation test patch study. The fabric was applied topcoat surface towards the skin for a period of seven days. No irritation to the skin was found.

Fabric 10 may be coated with adhesive alone or in combination with loosely woven cotton gauze (for example) to provide an adhesive tape and an adhesive bandage, respectively. Any type of adhesive which is hypoallergenic, and preferably breathable may be used. Conventional pressure-sensitive adhesives such as acrylate polymers may be used. The adhesive may be applied to fabric 10 by conventional methods well known to those skilled in the art.

The adhesive may be applied to either exposed surface of fabric 10, i.e. to the exposed surface of substrate 12 or to the exposed surface of topcoat 16. The latter configuration allows lateral air flow through the edges of the fabric to reach a wound (for example) covered by the fabric. Air flow is achieved via the microporous polyurethane topcoat. Air flows through the micropores and when the topcoat layer is positioned towards the skin, air flows directly to the wound.

What is claimed is:

1. A waterproof, moisture-breathable, and hypoallergenic fabric comprising:

a moisture-absorbent, non-macerating hypoallergenic substrate formed from natural or synthetic fibers, the moisture absorbency of said substrate being provided by the inherent moisture absorbency of the fiber selected and the attractive capillarity of the formed substrate;

an acrylic polymer basecoat coated onto said substrate, said basecoat having sufficient viscosity when applied to prevent strikethrough when said basecoat is applied to said substrate; and a topcoat selected from the group consisting of polyether urethane and silicone latex coated onto said basecoat, whereby said fabric can maintain prolonged direct contact with skin without causing maceration.

2. The fabric of claim 1 wherein said fibers are selected from the group consisting of cotton, wool, paper, polyester, polyester/cotton, acrylic, modacrylic, rayon, acetate, triacetate, nylon 66, nylon 6, spandex, glass, anidex, saran, matrix, aglon and "TEFLON".

3. The fabric of claim 1 wherein said substrate is formed by weaving said fibers.

4. The fabric of claim 1 wherein said substrate is formed by knitting said fibers.

5. The fabric of claim 1 wherein said substrate is non-woven in dot or scrim pattern.

6. The fabric of claim 1 further comprising an adhesive layer applied to an exposed surface of said fabric.

7. The fabric of claim 1 wherein said topcoat is microporous polyether urethane.

8. The fabric of claim 1 wherein said topcoat includes pigment.

9. The fabric of claim 1 wherein said basecoat includes pigment.

10. The fabric of claim 1 wherein said substrate includes pigment.

11. The fabric of claim 1 wherein said basecoat has a thickness of from about 0.1 mil to about 10 mil.

12. The fabric of claim 1 wherein said topcoat has a thickness of from about 0.1 mil to about 10 mil.

* * * * *